US009210747B2

(12) United States Patent
Zhang

(10) Patent No.: US 9,210,747 B2
(45) Date of Patent: Dec. 8, 2015

(54) DRIVER FOR DRIVING LED BACKLIGHT SOURCE, LED BACKLIGHT SOURCE AND LCD DEVICE

(71) Applicant: Shenzhen China Star Optoelectronics Technology Co., Ltd., Shenzhen, Guangdong (CN)

(72) Inventor: Hua Zhang, Shenzhen (CN)

(73) Assignee: Shenzhen China Star Optoelectronics Technology Co., Ltd, Shenzhen, Guangdong ( * ) Notice: Subject to any disclaimer, the term of this patent is extended or adjusted under 35 U.S.C. 154(b) by 33 days.

(21) Appl. No.: 13/980,030

(22) PCT Filed: Jun. 26, 2013

(86) PCT No.: PCT/CN2013/077997

§ 371 (c)(1),
(2) Date: Jul. 16, 2013

(87) PCT Pub. No.: WO2014/205671

PCT Pub. Date: Dec. 31, 2014

(65) Prior Publication Data

US 2014/0375930 A1 Dec. 25, 2014

(30) Foreign Application Priority Data

Jun. 24, 2013 (CN) ..... 2013 1 0253835

(51) Int. Cl.

| | |
|---|---|
| ***H05B 37/02*** | (2006.01) |
| ***H05B 33/08*** | (2006.01) |
| ***G09G 3/34*** | (2006.01) |

(52) U.S. Cl.

CPC ..... *H05B 33/0815* (2013.01); *G09G 3/3413* (2013.01); *H05B 33/0824* (2013.01); *G09G 2320/043* (2013.01); *G09G 2330/02* (2013.01); *G09G 2330/021* (2013.01); *G09G 2330/028* (2013.01)

(58) Field of Classification Search

CPC ..... H05B 33/0815; H05B 33/0818; H05B 341/3927; H05B 41/3925

USPC ..... 315/291, 185 R, 307, 362; 323/305

See application file for complete search history.

(56) References Cited

U.S. PATENT DOCUMENTS

| | | | | |
|---|---|---|---|---|
| 8,035,315 | B2 * | 10/2011 | Zhao et al. | 315/299 |
| 8,947,407 | B2 * | 2/2015 | Williams | H05B 33/0827 315/122 |
| 9,030,459 | B2 * | 5/2015 | Jang | H05B 33/0815 315/192 |

(Continued)

*Primary Examiner* — Douglas W Owens
*Assistant Examiner* — Syed M Kaiser
(74) *Attorney, Agent, or Firm* — Andrew C. Cheng

(57) ABSTRACT

A driver for driving an LED backlight source is disclosed. The driver includes a boost converter for boosting inputted DC voltage and outputting boosted DC voltage to an LED series circuit having LEDs connected and a resistor in series, a feedback circuit for feeding back voltage across the resistor to a backlight driving circuit, and a control switch controlled by output of the backlight driving circuit depending on feedback voltage of the voltage across the resistor for keeping current flowing through the LED series circuit in a constant current. The driver drives the LED series circuit with a constant current, thereby prolonging lifetime of each LED of the LED series circuit. Furthermore, since a time period which the current flowing through the LED series circuit approaches to constant value is shorter, the driver has advantages over lower power consumption, faster response time and better operating efficiency.

12 Claims, 2 Drawing Sheets

(56) References Cited

U.S. PATENT DOCUMENTS

| | | | | |
|---|---|---|---|---|
| 9,035,566 | B2 * | 5/2015 | Du | H05B 33/0818 315/291 |
| 2006/0175986 | A1 * | 8/2006 | Lee et al. | 315/312 |
| 2008/0198615 | A1 * | 8/2008 | Klipstein | 362/538 |
| 2009/0262988 | A1 * | 10/2009 | Karkanias et al. | 382/118 |
| 2010/0315019 | A1 * | 12/2010 | Hoogzaad et al. | 315/291 |
| 2012/0206946 | A1 * | 8/2012 | Sagneri et al. | 363/68 |
| 2012/0274228 | A1 * | 11/2012 | Szczeszynski | 315/224 |
| 2012/0313536 | A1 * | 12/2012 | Kim et al. | 315/186 |
| 2013/0026926 | A1 * | 1/2013 | Oh et al. | 315/122 |
| 2013/0099684 | A1 * | 4/2013 | Cheng et al. | 315/186 |
| 2013/0147358 | A1 * | 6/2013 | Kotowski et al. | 315/122 |
| 2013/0147360 | A1 * | 6/2013 | Kang | 315/122 |
| 2014/0339997 | A1 * | 11/2014 | Tsuchida | H05B 33/0815 315/210 |

* cited by examiner

DRIVER FOR DRIVING LED BACKLIGHT SOURCE, LED BACKLIGHT SOURCE AND LCD DEVICE

BACKGROUND OF THE INVENTION

1. Field of the Invention

The present invention relates to a liquid crystal display (LCD) field, more particularly, to a driver for rapidly adjusting current flowing through a light emitting diode (LED) series circuit of a LED backlight source to a constant current, an related LED backlight source using the driver and an LCD device using the LED backlight source.

2. Description of the Prior Art

As the progress of display technology, backlighting used in the LCD device has been developed. A cold cathode fluorescent lamp (CCFL) for use in a backlight source of a traditional LCD device presents disadvantages over poor color recovery, low lighting efficiency, high discharging voltage, poor discharging characteristic under low temperature and long time period to be heated to emit light with steady grey level. Nowadays, many LED backlight sources are developed.

The LED backlight source are disposed near the LCD panel in the LCD device, so that the LCD panel shows images by using light emitted by the LED backlight source. The LED backlight source includes an LED series circuit having multiple LEDs connected in serial. A specific driver is designed for supplying driving voltage to the LED series circuit. For prolonging lifetime of each LED, driving the LED series circuit with a constant current is required. However, the conventional driver needs a longer time period which the current flowing through the LED series circuit approaches to constant value, and causes higher power consumption, slower response time and worse operating efficiency.

SUMMARY OF THE INVENTION

It is therefore an object of the present invention is to provide a driver for driving LED backlight source, an LED backlight source and an LCD device drives the LED series circuit with a constant current to solve the problem as presented in the prior art.

In one aspect of the present invention, a driver for driving a light emitting diode backlight source comprises a boost converter, for boosting inputted direct current (DC) voltage and outputting boosted DC voltage to a light emitting diode (LED) series circuit having a plurality of LEDs connected and a resistor in series, a feedback circuit, for feeding back voltage across the resistor to a backlight driving circuit, and a control switch controlled by output of the backlight driving circuit depending on feedback voltage of the voltage across the resistor, for keeping current flowing through the LED series circuit in a constant current.

In another aspect of the present invention, an LED backlight source for use in an LCD device, comprises a boost converter, for boosting inputted direct current (DC) voltage and outputting boosted DC voltage, an light emitting diode (LED) series circuit having a plurality of LEDs connected and a resistor connected in series, a feedback circuit, for feeding back voltage across the resistor to a backlight driving circuit, and a control switch controlled by output of the backlight driving circuit depending on feedback voltage of the voltage across the resistor, for keeping current flowing through the LED series circuit in a constant current.

In another aspect of the present invention, an LCD device comprising an LED backlight source and an LCD panel disposed near the LED backlight source to display image by using light emitted from the LED backlight source is provided. The LED backlight source comprises a boost converter, for boosting inputted direct current (DC) voltage and outputting boosted DC voltage, an light emitting diode (LED) series circuit having a plurality of LEDs connected and a resistor connected in series, a feedback circuit, for feeding back voltage across the resistor to a backlight driving circuit, and a control switch controlled by output of the backlight driving circuit depending on feedback voltage of the voltage across the resistor, for keeping current flowing through the LED series circuit in a constant current.

Furthermore, the backlight driving circuit comprise a control module, for adjusting a duty cycle of a driving signal fed to the boost converter based on voltage applied on a negative end of the LED series circuit, to control magnitude of the boosted DC voltage; and an operational amplifier having a negative end coupled to the feedback voltage of the voltage across the resistor through the feedback circuit and a positive end coupled to a reference voltage, for outputting different voltage level signals to control the control switch according to a comparison between the reference voltage and the feedback voltage of the voltage across the resistor through the feedback circuit.

Furthermore, the boosting converter comprises a diode comprising a positive and a negative end coupled to the LED series circuit, an inductor, coupled between the inputted DC voltage and the negative of the diode, a metal oxide semiconductor (MOS) transistor comprising a drain coupled the positive end of the diode, a source coupled to ground, and a gate coupled to the control module, and a capacitor coupled between the negative end of the diode and the ground.

Furthermore, the feedback circuit comprises a differential amplifier for feeding back the voltage across the resistor to the negative end of the operational amplifier.

Furthermore, the control switch is a bipolar junction transistor comprising a collector coupled to the resistor, an emitter coupled to the ground, and a base coupled to an output of the operational amplifier of the backlight driving circuit.

In contrast to the prior art, the driver for driving LED backlight source, the LED backlight source and the LCD device drives the LED series circuit with a constant current, thereby prolonging lifetime of each LED of the LED series circuit. Furthermore, since a time period which the current flowing through the LED series circuit approaches to constant value is shorter, the driver for driving the LED backlight source has advantages over lower power consumption, faster response time and better operating efficiency.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
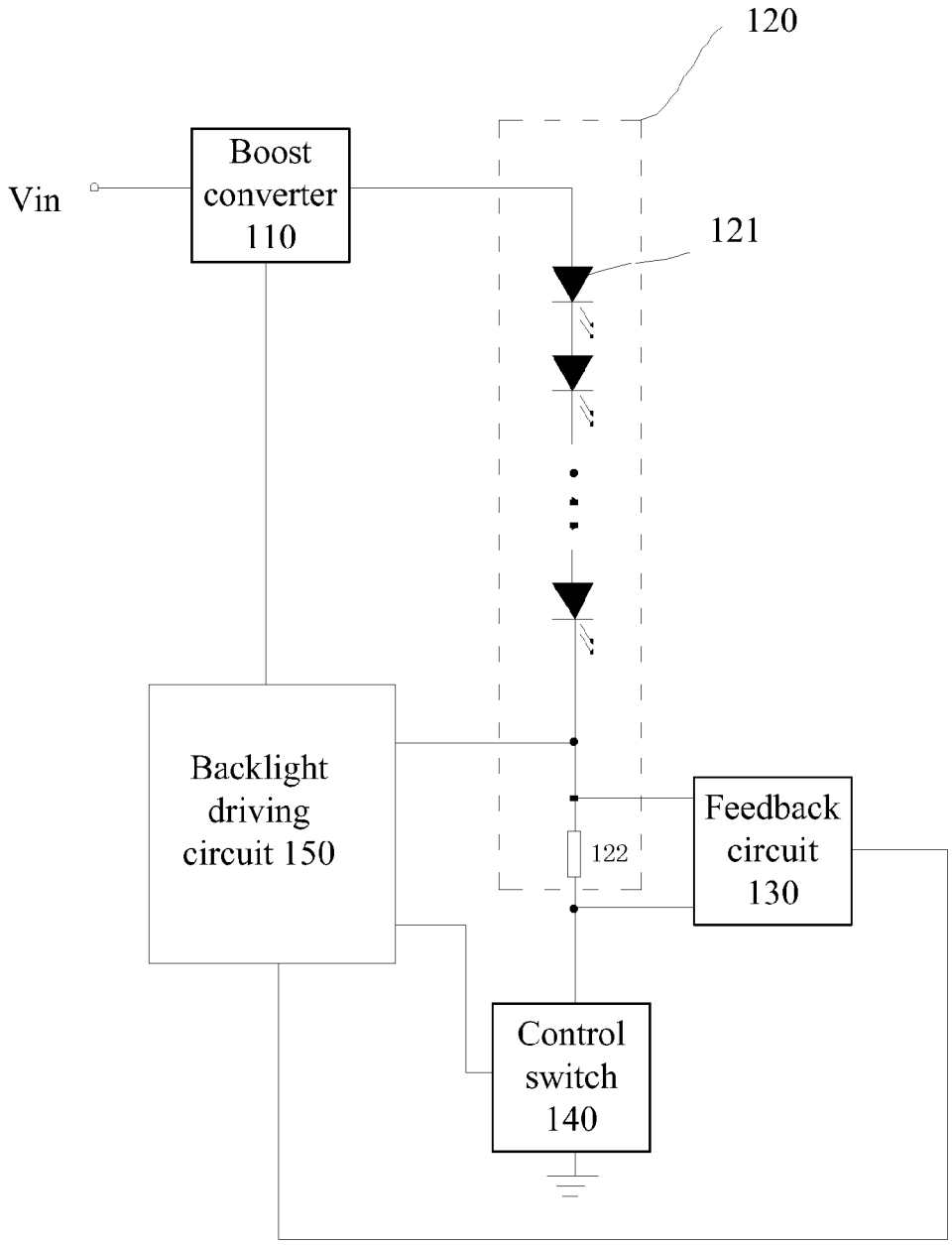
FIG. 1 shows an LED backlight source for use in an LCD device according to a preferred embodiment of the present invention.

Referring to FIG. 1, a light emitting diode (LED) backlight source for use in a liquid crystal display (LCD) device is shown according to a preferred embodiment of the present invention.

As shown in FIG. 1, the LED backlight source for use in the LCD device comprises a boost converter 110, an LED series circuit 120, a feedback circuit 130, a control switch 140, and a backlight driving circuit 150.

The boost converter 110 is used for boosting inputted direct current (DC) voltage and outputting boosted DC voltage.

The LED series circuit 120 having a plurality of LEDs 121 connected and a resistor 122 in series is used to emit light to a LCD panel. The LED series circuit 120 receives the boosted DC voltage from the boost converter 110.

A number N (N is a positive integer) of the LEDs 121 in the LED series circuit 120 is determined by a formula as follow:

$$N \times Vd \leq Vs,$$

Where Vd indicates driving voltage of each LED 121, and Vs indicates an output voltage of the boost converter 110.

For example, upon the condition that Vd=6.5V, and Vs=48V, N≤7.

The feedback circuit 130 is used for feeding back voltage across the resistor 122 to the backlight driving circuit 150.

The control switch 140, controlled by output of the backlight driving circuit 150 depending on feedback voltage of the voltage across the resistor 122, is used for keeping current flowing through the LED series circuit 120 in a constant current. Since the control switch 140 present advantages over faster switching, shorter time period of adjusting current flowing through the LED series circuit in a constant current, and lower power consumption, the driver for use in the LED backlight source may drive the LED series circuit faster and upgrade efficiency accordingly.

The backlight driving circuit 150 can be integrated within a backlight driving IC chip. The backlight driving circuit 150 is used for adjusting a duty cycle of a driving signal fed to the boost converter 110, and for controlling magnitude of the boosted DC voltage. The control switch 140 is controlled by output of the backlight driving circuit 150 depending on feedback voltage of the voltage across the resistor 122, so that the control switch 140 is used for keeping current flowing through the LED series circuit 120 in a constant current.

Figure 2:
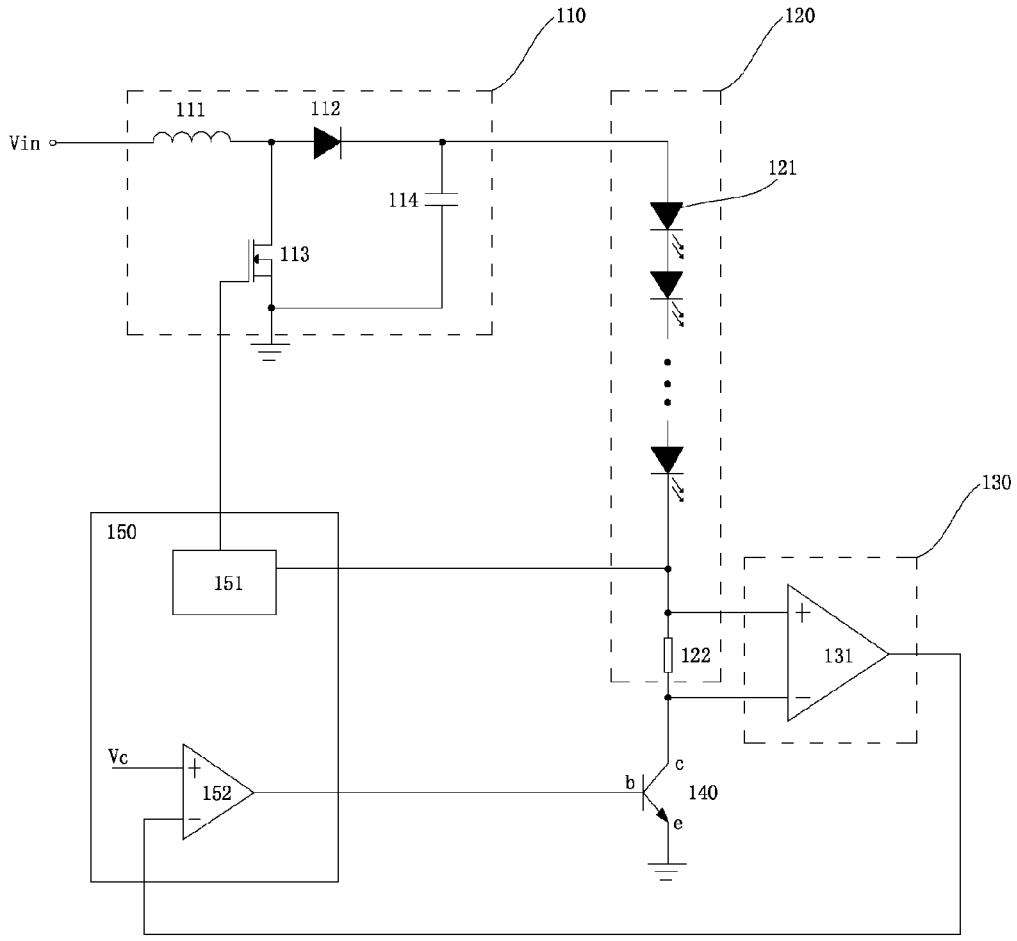
FIG. 2 shows a boost converter, a feedback circuit, a control switch and a backlight driving circuit according to a preferred embodiment of the present invention.

Referring to FIG. 2, a LED backlight source comprises a boost converter, a feedback circuit, a control switch, and a backlight driving circuit according to a preferred embodiment of the present invention.

As shown in FIG. 2, the boost converter 110 comprises an inductor 111, a metal oxide semiconductor (MOS) transistor 112, a diode 113, and a capacitor 114.

The inductor 111 is coupled between the inputted DC voltage Vin and a positive end of the diode 112. A negative end of the diode 112 is coupled a positive end of the LED series circuit 120. A drain D, a source S, and a gate G of the MOS transistor 113 are coupled to a positive end of the diode 112, ground, and control module 151 of the backlight driving circuit 150, respectively. The capacitor 114 is coupled between a negative end of the diode 112 and the ground.

A control module 151 of the backlight driving module 150 can adjust a duty cycle of a driving signal fed to the gate G of the MOS transistor 113 based on voltage applied on a negative end of the LED series circuit 120, so as to control magnitude of the boosted DC voltage. For example, when the driver used in the LED backlight source begins to work, a magnitude of the boosted DC voltage outputted from the boost converter 110 is insufficient to light up the LED series circuit 120, causing that no current flows through the LED series circuit 120, voltage drop across each LED 121 is smaller, and voltage applied on the negative end of the LED series circuit 120 is greater. Upon detecting the greater voltage applied on the negative end of the LED series circuit 120, the control module 151 outputs the driving signal with a greater duty cycle to the gate G of the MOS transistor 113 to raise the magnitude of the boosted DC voltage from the boost converter 110 until the LED series circuit 120 lights up normally. At this moment, the control module 151 outputs the driving signal with a constant duty cycle to steadily supply power to the LED series circuit 120.

In another embodiment, the control switch 140 of the LED backlight source can be a Bipolar Junction Transistor (BJT). When the BJT turns on, a voltage drop between a base and a emitter is approximately 0.7V, and current flowing through the collector c is hundred times as much as current flowing through the base b (the hundred times indicates an amplifying number of the BJT). For example, when current flowing through the base b is one mA, the current flowing through the collector c is one hundred mA. Moreover, the BJT presents advantages over easy control, short response time period and low power consumption.

In this embodiment, the BJT is connected to the LED series circuit 120 in serial. A collector c of the BJT is coupled to the resistor 122, an emitter e of the BJT is grounded, and a base b of the BJT is coupled to an output of the operational amplifier 152 of the backlight driving circuit 150. In this way, the current flowing through the collector c of the BJT equals to that flowing through the LED series circuit 120.

In this embodiment, the feedback circuit 130 of the LED backlight source comprises a differential amplifier 131 which is used for measuring a precise voltage across the resistor 122. Additionally, the differential amplifier 131 may be replaced by other electrical elements capable of measuring precise voltage across the resistor 122, such as a subtractor.

A positive end of the differential amplifier 131 is coupled between the negative end of the multiple LEDs 121 and the resistor 122, and a negative end of the differential amplifier 131 is coupled between the collector c of the BJT and the resistor 122, an output end of the differential amplifier 131 is coupled to a negative end of the operational amplifier 152 of the backlight driving circuit 150.

The voltage across the resistor 122 is feedback to the negative end of the operational amplifier 152 through the differential amplifier 131.

In this embodiment, the backlight driving circuit 150 comprises a control module 151 and the operational amplifier 152.

The control module 151 is coupled between the gate G of MOS transistor 113 of the boost converter 110 and the negative end of the LED series circuit 120.

In addition to the above function, the control module 151 protects the LED series circuit 120 from malfunction upon the LED series circuit 120 lights up and emits light. For example, when the LED series circuit 120 is open-circuited or short-circuited, the control module 151 detects abnormal voltage applied on the negative end of the LED series circuit 120 and thus stops outputting driving signal to the gate G of the MOS transistor 113 so as to shut down the driver.

The negative end of the operational amplifier 152 is coupled to the output of the differential amplifier 131 of the feedback circuit 130, the positive end of the operational amplifier 152 is coupled to a reference voltage Vc generated by the backlight driving circuit 150, and the output of the operational amplifier 152 is coupled to the base b of the BJT. The operational amplifier 152 having a negative end coupled to the feedback voltage of the voltage across the resistor 122 through the output of the differential amplifier 131 and a positive end coupled to a reference voltage Vc. The operational amplifier 152 compares the feedback voltage of the voltage across the resistor 122 with the reference voltage Vc.

When the feedback voltage of the voltage across the resistor 122 is less than the reference voltage Vc, the operational amplifier 152 outputs high voltage level to raise the current flowing through the base b of the BJT. Since the current flowing through the base b is proportional to that flowing through the collector c, the current flowing through the LED series circuit 120 increases. When the feedback voltage of the voltage across the resistor 122 is greater than the reference voltage Vc, the operational amplifier 152 outputs low voltage level to reduce the current flowing through the base b of the BJT. Since the current flowing through the base b is proportional to that flowing through the collector c, the current flowing through the LED series circuit 120 decreases. Upon the condition that the feedback voltage of the voltage across the resistor 122 equals to the reference voltage Vc, the current flowing through the base b of the BJT becomes a constant current, as well as the current flowing through the LED series circuit 120 becomes a constant current.

In this embodiment, the control switch comprises but is not limited to the BJT. In another embodiment, the control switch may be other switches with short response time period and low power consumption.

Figure 3:
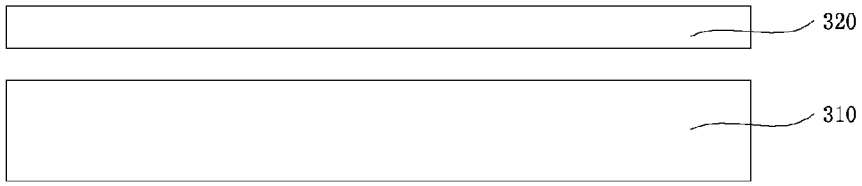
FIG. 3 shows an LCD device according to a preferred embodiment of the present invention.

In addition, the above LED backlight source can be applied in an LCD device, as depicted in FIG. 3.

FIG. 3 shows an LCD device according to a preferred embodiment of the present invention.

As shown in FIG. 3, the LCD device comprises an LED backlight source 310 and an LCD panel 320 disposed near the LED backlight source 310. Since the LCD panel 320 does not emit light, the LCD panel 320 displays image by using light emitted from the LED backlight source 310. Preferably, the LED backlight source 310 can be the LED backlight source as shown in FIG. 2.

According to the present invention, the driver for driving LED backlight source, the LED backlight source and the LCD device drives the LED series circuit with a constant current, thereby prolonging lifetime of each LED of the LED series circuit. Furthermore, since a time period which the current flowing through the LED series circuit approaches to constant value is shorter, the driver for driving the LED backlight source has advantages over lower power consumption, faster response time and better operating efficiency.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driver for driving a light emitting diode backlight source, comprising:

a boost converter, for boosting inputted direct current (DC) voltage and outputting boosted DC voltage to a light emitting diode (LED) series circuit having a plurality of LEDs connected and a resistor in series;

a feedback circuit, for feeding back voltage across the resistor to a backlight driving circuit; and a control switch controlled by output of the backlight driving circuit depending on feedback voltage of the voltage across the resistor, for keeping current flowing through the LED series circuit in a constant current, wherein the backlight driving circuit comprises:

a control module, coupled to one end of the LED series, for adjusting a duty cycle of a driving signal fed to the boost converter based on voltage applied on a negative end of the LED series circuit, to control magnitude of the boosted DC voltage; and an operational amplifier having an output end directly connected to the control switch, a negative end coupled to the feedback voltage of the voltage across the resistor through the feedback circuit and a positive end coupled to a reference voltage, for outputting different voltage level signals to control the control switch according to a comparison between the reference voltage and the feedback voltage of the voltage across the resistor through the feedback circuit.

2. The driver as claimed in claim 1 wherein the boosting converter comprises:

a diode comprising a positive and a negative end coupled to the LED series circuit;

an inductor, coupled between the inputted DC voltage and the positive end of the diode;

a metal oxide semiconductor (MOS) transistor comprising a drain coupled the positive end of the diode, a source coupled to ground, and a gate coupled to the control module; and a capacitor coupled between the negative end of the diode and the ground.

3. The driver as claimed in claim 1 wherein the feedback circuit comprises a differential amplifier for feeding back the voltage across the resistor to the negative end of the operational amplifier.

4. The driver as claimed in claim 1 wherein the control switch is a bipolar junction transistor comprising a collector coupled to the resistor, an emitter coupled to the ground, and a base coupled to an output of the operational amplifier of the backlight driving circuit.

5. A LED backlight source for use in a LCD device, comprising:

a boost converter, for boosting inputted direct current (DC) voltage and outputting boosted DC voltage;

a light emitting diode (LED) series circuit having a plurality of LEDs connected and a resistor connected in series;

a feedback circuit, for feeding back voltage across the resistor to a backlight driving circuit; and a control switch controlled by output of the backlight driving circuit depending on feedback voltage of the voltage across the resistor, for keeping current flowing through the LED series circuit in a constant current, wherein the backlight driving circuit comprises:

a control module, coupled to one end of the LED series, for adjusting a duty cycle of a driving signal fed to the boost converter based on voltage applied on a negative end of the LED series circuit, to control magnitude of the boosted DC voltage; and an operational amplifier having an output end directly connected to the control switch, a negative end coupled to the feedback voltage of the voltage across the resistor through the feedback circuit and a positive end coupled to a reference voltage, for outputting different voltage level signals to control the control switch according to a comparison between the reference voltage and the feedback voltage of the voltage across the resistor through the feedback circuit.

6. The LED backlight source as claimed in claim 5 wherein the boosting converter comprises:

a diode comprising a positive and a negative end coupled to the LED series circuit;

an inductor, coupled between the inputted DC voltage and the negative of the diode;

a metal oxide semiconductor (MOS) transistor comprising a drain coupled the positive end of the diode, a source coupled to ground, and a gate coupled to the control module; and a capacitor coupled between the negative end of the diode and the ground.

7. The LED backlight source as claimed in claim 5 wherein the feedback circuit comprises a differential amplifier for feeding back the voltage across the resistor to the negative end of the operational amplifier.

8. The LED backlight source as claimed in claim 5 wherein the control switch is a bipolar junction transistor comprising a collector coupled to the resistor, an emitter coupled to the ground, and a base coupled to an output of the operational amplifier of the backlight driving circuit.

9. A LCD device comprising a LED backlight source and a LCD panel disposed near the LED backlight source to display image by using light emitted from the LED backlight source, the LED backlight source comprising:

a boost converter, for boosting inputted direct current (DC) voltage and outputting boosted DC voltage;

a light emitting diode (LED) series circuit having a plurality of LEDs connected and a resistor connected in series;

a feedback circuit, for feeding back voltage across the resistor to a backlight driving circuit; and a control switch controlled by output of the backlight driving circuit depending on feedback voltage of the voltage across the resistor, for keeping current flowing through the LED series circuit in a constant current, wherein the backlight driving circuit comprises:

a control module, coupled to one end of the LED series, for adjusting a duty cycle of a driving signal fed to the boost converter based on voltage applied on a negative end of the LED series circuit, to control magnitude of the boosted DC voltage; and an operational amplifier having an output end directly connected to the control switch, a negative end coupled to the feedback voltage of the voltage across the resistor through the feedback circuit and a positive end coupled to a reference voltage, for outputting different voltage level signals to control the control switch according to a comparison between the reference voltage and the feedback voltage of the voltage across the resistor through the feedback circuit.

10. The LCD device as claimed in claim 9 wherein the boosting converter comprises:

a diode comprising a positive and a negative end coupled to the LED series circuit;

an inductor, coupled between the inputted DC voltage and the negative of the diode;

a metal oxide semiconductor (MOS) transistor comprising a drain coupled the positive end of the diode, a source coupled to ground, and a gate coupled to the control module; and a capacitor coupled between the negative end of the diode and the ground.

11. The LCD device as claimed in claim 9 wherein the feedback circuit comprises a differential amplifier for feeding back the voltage across the resistor to the negative end of the operational amplifier.

12. The LCD device as claimed in claim 9 wherein the control switch is a bipolar junction transistor comprising a collector coupled to the resistor, an emitter coupled to the ground, and a base coupled to an output of the operational amplifier of the backlight driving circuit.

* * * * *